US008756874B2

(12) United States Patent
Hurlebaus et al.

(10) Patent No.: US 8,756,874 B2
(45) Date of Patent: Jun. 24, 2014

(54) TRAFFIC SIGNAL SUPPORTING STRUCTURES AND METHODS

(75) Inventors: Stefan Hurlebaus, College Station, TX (US); John B. Mander, College Station, TX (US)

(73) Assignee: The Texas A&M University System, College Station, TX (US)

( * ) Notice: Subject to any disclaimer, the term of this patent is extended or adjusted under 35 U.S.C. 154(b) by 0 days.

(21) Appl. No.: 13/425,298

(22) Filed: Mar. 20, 2012

(65) Prior Publication Data

US 2012/0240498 A1 Sep. 27, 2012

Related U.S. Application Data

(60) Provisional application No. 61/454,864, filed on Mar. 21, 2011.

(51) Int. Cl.

| | |
|---|---|
| ***E04B 1/34*** | (2006.01) |
| ***E04H 12/24*** | (2006.01) |
| ***E01F 9/011*** | (2006.01) |
| *G08G 1/095* | (2006.01) |

(52) U.S. Cl.

CPC ..... *E04H 12/24* (2013.01); *G08G 1/095* (2013.01); *E01F 9/0113* (2013.01)

USPC ..... 52/73; 52/223.8

(58) Field of Classification Search

USPC ..... 52/223.8, 73, 223.14, 573.1, FOR. 153; 403/190, 191, 196, 197; 248/219.1, 248/548, 214, 228.5

See application file for complete search history.

(56) References Cited

U.S. PATENT DOCUMENTS

| | | | | | |
|---|---|---|---|---|---|
| 484,565 | A | * | 10/1892 | Allison et al. | 248/323 |
| 2,928,641 | A | * | 3/1960 | Pfaff, Jr. | 248/219.1 |
| 2,963,764 | A | * | 12/1960 | Finsterwalder | 264/34 |
| 2,966,324 | A | * | 12/1960 | Heinzen | 248/219.1 |
| 3,233,853 | A | * | 2/1966 | Majewski | 248/74.4 |
| 3,605,364 | A | * | 9/1971 | Ford | 52/291 |
| 3,732,655 | A | * | 5/1973 | Termohlen et al. | 52/73 |
| 3,764,099 | A | * | 10/1973 | Parduhn | 248/214 |
| 3,835,607 | A | * | 9/1974 | Raaber | 52/223.8 |
| 3,854,685 | A | * | 12/1974 | Parduhn | 248/214 |
| 4,275,537 | A | * | 6/1981 | Pinson | 52/223.8 |
| 4,313,287 | A | * | 2/1982 | Romig, Jr. | 52/223.4 |
| 4,676,045 | A | | 6/1987 | Ellen | |
| 4,685,253 | A | * | 8/1987 | Bitterly | 52/2.11 |
| 4,805,862 | A | * | 2/1989 | Wissman | 248/229.1 |
| 5,113,631 | A | * | 5/1992 | diGirolamo et al. | 52/236.8 |
| 5,292,014 | A | * | 3/1994 | Lelong | 211/85.23 |

(Continued)

OTHER PUBLICATIONS

D. E. Walshe, BSc et al., "Preventing wind-induced oscillations of structures of circular section", 1971, 24 pages.

(Continued)

*Primary Examiner* — Brent W Herring

(74) *Attorney, Agent, or Firm* — Fletcher Yoder P.C.

(57) ABSTRACT

The embodiments presented herein include systems and methods for mitigating fatigue and fracture in mast-and-arm supporting structures caused by wind and other excitation forces. In particular, the embodiments presented herein utilize pre-stressed devices to reduce tensile stresses in arm-to-mast connections and/or mast-to-foundation connections of the traffic signal supporting structures. Present embodiments may employ stressed cables, post-tensioned bars (e.g., DYWIDAG bars), threaded rods, and so forth, to mitigate fatigue and fracture in the traffic signal supporting structures.

18 Claims, 12 Drawing Sheets

(56) References Cited

U.S. PATENT DOCUMENTS

| | | | | |
|---|---|---|---|---|
| 5,301,482 | A * | 4/1994 | Aspenwall | 52/223.1 |
| 5,601,274 | A * | 2/1997 | Minor et al. | 248/594 |
| 5,809,713 | A * | 9/1998 | Ray | 52/223.9 |
| 5,860,734 | A * | 1/1999 | Rodgers et al. | 362/369 |
| 6,256,943 | B1 | 7/2001 | Mander et al. | |
| 6,685,154 | B1 * | 2/2004 | Blyth et al. | 248/512 |
| 6,820,389 | B1 * | 11/2004 | Macchietto | 52/835 |
| 6,857,615 | B2 * | 2/2005 | Puckett et al. | 248/548 |
| 7,165,870 | B2 * | 1/2007 | McKenney | 362/369 |
| 7,685,791 | B2 * | 3/2010 | Nahlen et al. | 52/651.01 |
| 2004/0065030 | A1 * | 4/2004 | Zambelli et al. | 52/223.13 |

OTHER PUBLICATIONS

M. M. Zdravkovich, et al., "Reduction of effectiveness of means for suppressing wind-induced oscillation", Eng. Struct., 1984, p. 344-349, vol. 6, 6 pages.

Robin L Hutchinson, P. Eng., et al., "Horizontal Post-Tensioned Connections for Precast Concrete Loadbearing Shear Wall Panels", PCI Journal, Nov.-Dec. 1991, p. 64-76, 13 pages.

Narendra Pulipaka, et al., "On galloping vibration of traffic signal structures", Journal of Wind Engineering and Industrial Aerodynamics 77 & 78, 1998, p. 327-336, Elsevier Science Ltd., 10 pages.

R. A. Cook, et al., "Damping of Cantilevered Traffic Signal Structures", Journal of Structural Engineering, Dec. 2001, p. 1476-1483, vol. 127, No. 12, ASCE, 8 pages.

Fouad H. Fouad, et al., "Structural Supports for Highway Signs, Luminaires, and Traffic Signals", NCHRP report 494, 2003, Transportation Research Board, Washington, D.C., 59 pages.

P. S. McManus, et al., "Damping in Cantilevered Traffic Signal Structures under Forced Vibration", Journal of Structural Engineering, Mar. 2003, p. 373-382, vol. 129, No. 3, ASCE, 10 pages.

Glenda Chen, Ph.D., P.E., et al., "Signal Mast Arm Failure Investigation", Final Report, Jul. 2003, Missouri Department of Transportation Research, Development and Technology, Jefferson City, MO., 70 pages.

Michael J. Garlich, S.E., P.E., et al., "Guidelines for the Installation, Inspection, Maintenance and Repaid of Structural Supports for Highway Signs, Luminaries, and Traffic Signals", Mar. 2005, 148 pages.

Justin M. Ocel, et al., "Fatigue-Resistant Design for Overhead Signs, Mast-Arm Signal Poles, and Lighting Standards", Mar. 2006, 190 pages.

Luca Caracoglia, et al., "Numerical and experimental study of vibration mitigation for highway light poles", Science Direct, 2006, p. 821-831, Elsevier Ltd., 11 pages.

Andrew Budek, TechMRT, et al., "0-4586: Revision of AASHTO Fatigue Design Loadings for Signs, Luminaires, and Traffic Signal Structures, for Use in Texas", 2007, Texas Department of Transportation, 2 pages.

Delong Zuo, "Field Observations of Wind-Induced Lighting Pole Vibration", 2008, 6 pages.

Raghavan A. Kumar, et al., "Passive Control of Vortex-Induced Vibrations: An Overview", Recent Patents on Mechanical Engineering, 2008, p. 1-11, vol. 1, No. 1, Bentham Science Publishers Ltd., 11 pages.

Christopher J. Letchford, et al., "Risk Assessment Model for Win-Induced Fatigue Failure of Cantilever Traffic Signal Structures", May 2008, Texas Tech University, 246 pages.

Christopher M. Foley, PhD., PE, et al., "Fatigue Risks in the Connections of Sign Support Structures Phase 1", Wisconsin Highway Research Program, Dec. 2008, 214 pages.

* cited by examiner

TRAFFIC SIGNAL SUPPORTING STRUCTURES AND METHODS

RELATED APPLICATIONS

This application claims priority to U.S. Provisional Application No. 61/454,864, which was filed on Mar. 21, 2011, and which is incorporated herein by reference in its entirety.

BACKGROUND OF THE DISCLOSURE

Support structures including a mast and arm component, such as a typical steel traffic signal supporting structure, are often subject to environmental forces that result in structural degradation and failure. For example, under excitation from wind, as well as traffic-induced drafting effects, traffic signal supporting structures often exhibit large amplitude vibrations that can result in reduced fatigue life of the arm-to-mast connections of these structures. The mechanism of the observed vibrations has been attributed to across-wind effects that lead to galloping of the signal clusters. The corresponding chaotic motion of the structural components leads to persistent stress and strain cycles that result in high cycle fatigue failure, particularly at the arm-to-mast connection. Various types of mitigation devices have been developed. Specifically, numerous devices have been directed to limiting stress cycles by increasing damping. However, it is now recognized that the effectiveness of these mitigation devices has been somewhat limited.

BRIEF DESCRIPTION OF THE DISCLOSURE

Certain embodiments commensurate in scope with the originally claimed invention are summarized below. These embodiments are not intended to limit the scope of the claimed invention, but, rather, these embodiments are intended only to provide a brief summary of possible forms of the invention. Indeed, the invention may encompass a variety of forms that may be similar to or different from the embodiments set forth below.

The embodiments presented herein include systems and methods for mitigating fatigue and fracture in support structures that include mast and arm components, which may be referred to herein as "mast-and-arm support structures." These mast-and-arm support structures, which are often used for traffic signal supporting structures, are typically subjected to wind and other excitation forces. The results of these types of external forces on the mast-and-arm support structures are mitigated by present embodiments. In particular, the embodiments presented herein utilize pre-stressed devices to reduce tensile stresses in arm-to-mast connections and/or mast-to-foundation connections of the mast-and-arm supporting structures. Specifically, for example, present embodiments may employ stressed cables, post-tensioned bars (e.g., DYWIDAG bars), threaded rods, and so forth, to mitigate fatigue and fracture in the mast-and-arm supporting structures (e.g., support structures for traffic signals, signs, wind mills, and the like).

The embodiments presented herein are directed toward removing the tension stresses in the arm-to-mast connection and/or a mast-to-foundation connection of the mast-and-arm supporting structure via pre-stressed devices. Rather than merely provide damping, the pre-stressed devices consistently remove tension stresses in the arm-to-mast connection during motion.

One embodiment includes mast-and-arm supporting structure having a mast extending substantially vertically from a foundation, and an arm extending substantially horizontally from an arm-to-mast connection that couples the arm to the mast. Further, the mast-and-arm supporting structure includes a post-tensioning device coupled proximate a first end of the post-tensioning device to the arm via a first bearing plate and coupled proximate a second opposite end of the post-tensioning device to the mast via a second bearing plate. In this embodiment, the post-tensioning device is pre-stressed.

One embodiment includes a mast-and-arm supporting structure having a metal mast extending substantially vertically from a coupling with a concrete foundation, and a metal arm cantilevered from the mast via an arm-to-mast connection such that the arm extends substantially horizontally from the mast. The mast-and-arm supporting structure also includes a post-tensioning device extending through an internal portion of the arm, wherein the post-tensioning device is pre-stressed. A first portion of the post-tensioning device is coupled to the arm via a first bearing plate, and a second portion of the post-tensioning device is coupled to the mast via a second bearing plate.

One embodiment is directed to a method that includes installing a post-tensioning device that is pre-stressed in an mast-and-arm supporting structure, wherein the mast-and-arm supporting structure comprise an arm cantilevered from a mast. The method includes coupling the post-tensioning device at a first portion of the post-tensioning device to the arm via a first bearing plate. Additionally, the method includes coupling the post-tensioning device at a second portion of the post-tensioning device to the mast via a second bearing plate. Further, the method includes applying stress to an arm-to-mast connection along the length of the arm through the post-tensioning device.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION OF THE INVENTION

One or more specific embodiments of the present disclosure will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," "the," and "said" are intended to mean that there are one or more of the elements. The terms "comprising," "including," and "having" are intended to be inclusive and mean that there may be additional elements other than the listed elements.

As described above, mast-and-arm supporting structures (e.g., traffic signal supporting structures) under excitation from wind and the like (e.g., drafting effects) often exhibit large amplitude vibrations that can result in reduced fatigue life of the arm-to-mast connection of these structures. The mechanism of the observed vibrations has been attributed to across-wind effects that lead to galloping along the arm. For example, the signal clusters on a traffic signal supporting structure are often caused to gallop due to across-wind effects. This chaotic motion leads to persistent stress and strain cycles on a mast-and-arm supporting structure that result in high cycle fatigue failure, particularly at the arm-to-mast connection. The embodiments presented herein include techniques for mitigation of these vibrational effects in mast-and-arm supporting structures such as traffic signal supporting structures, sign supporting structures, windmill supporting structures, equipment supporting structures, and the like.

Figure 1:
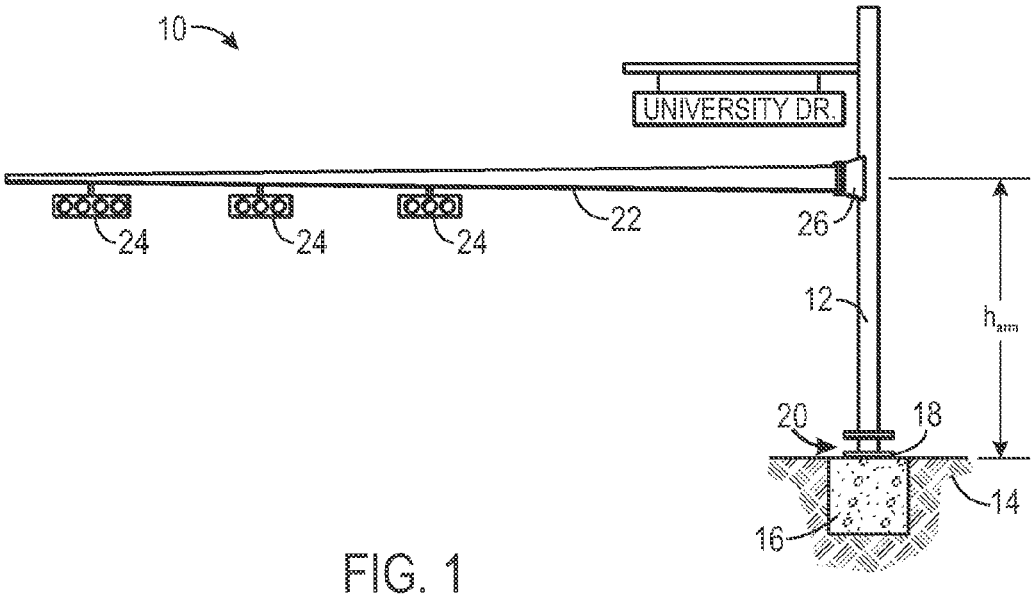
FIG. 1 is a side view of an exemplary mast-and-arm supporting structure including a traffic signal supporting structure that may benefit from the embodiments presented herein.

FIG. 1 is a side view of an exemplary mast-and-arm supporting structure, which includes a traffic signal supporting structure 10 that may benefit from the embodiments presented herein. In particular, the illustrated traffic signal supporting structure 10 includes a mast 12 (e.g., a pole shaft) that extends substantially vertically upward from the ground 14. In certain embodiments, the mast 12 may be attached to the ground 14 via a foundation 16, which may be embedded (e.g., buried) in the ground 14. In certain embodiments, the foundation 16 may be made of concrete or another suitable supporting structure. As illustrated, the mast 12 may be coupled to the foundation 16 via a base plate 18 (i.e., a mast-to-foundation connection), which attaches the mast 12 to the foundation 16 near a base end 20 of the mast 12. It should be noted that the base plate 18 may couple to the foundation 16 via bolts, screws, or the like (not shown) that extend into the foundation (e.g., concrete).

In the illustrated embodiment, at some vertical height $h_{arm}$ of the mast 12, an arm 22 extends substantially horizontally from the mast 12. For example, in certain embodiments, the arm 22 may extend from the mast 12 at a height $h_{arm}$ in the range of approximately 20-30 feet. In some embodiments, certain values of $h_{arm}$ may be desirable to accommodate other features. For example, in embodiments wherein a mast-and-arm supporting structure is supporting equipment, it may be desirable for $h_{arm}$ to be sufficient to accommodate the geometry of the stationary equipment or a range of movement for hoisted equipment. In the illustrated embodiment, the arm 22 supports a plurality of traffic signals 24.

Figure 2:
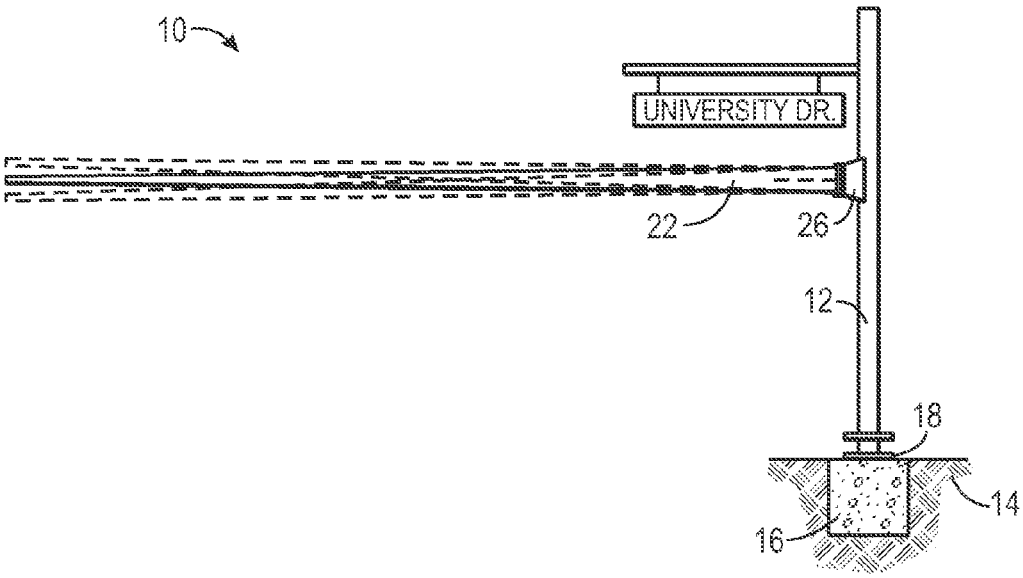
FIG. 2 is a side view of the mast-and-arm supporting structure of FIG. 1 during vibrational excitation, which is mitigated by present embodiments.

The arm 22 is coupled to the mast 12 via an arm-to-mast connection 26. As such, the arm 22 is essentially cantilevered to the mast 12 by the arm-to-mast connection 26. Due to various environmental factors mentioned above and discussed in greater detail below, the cantilevered nature of the arm 22 may cause the arm 22 to vibrate due to various excitation mechanisms. For example, FIG. 2 is a side view of the traffic signal supporting structure 10 (without the traffic signals 24) of FIG. 1 during vibrational excitation.

There are many different excitation mechanisms that may be responsible for wind-induced vibration, namely galloping, vortex shedding, natural wind gust, and traffic induced gust. Galloping is a large-amplitude vibration of a structure in the across-wind direction to the mean wind direction. Galloping occurs due to aerodynamic forces, which are initiated by small transverse motions of the structure. These initially small vibrations change the angle of attack of the wind onto the cross-section, significantly changing the lift and drag forces on the object, depending on the cross-sectional profile. Perfectly cylindrical objects are generally not subject to galloping, as changing the angle of attack has little impact on the lift and drag forces due to the symmetry of the cross-section.

Galloping can occur in the presence of both steady and unsteady wind. The forces are aerodynamic in nature and self-exciting, and act in the direction of the transverse motion resulting in negative damping, which increases the amplitude of the transverse motion until it settles down to a limited cycle. The prediction of the galloping amplitude typically relies on curve fittings of the aerodynamic transverse force functions, which may be obtained using wind tunnel experiments. The galloping of a structure occurs above a certain critical wind speed usually called the "onset wind speed."

Figure 3:
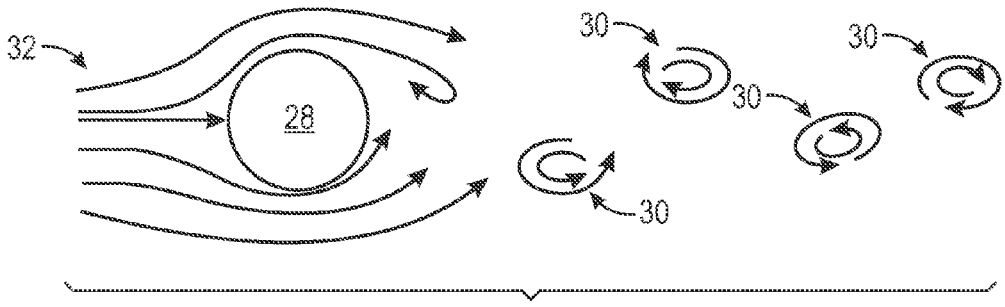
FIG. 3 illustrates the concept of vortex shedding across an object, which creates stresses mitigated in accordance with present embodiments.

Vortex shedding results in the presence of unsteady wind flow. As the wind flows around an object, low pressure vortices are created on alternate sides of the object. FIG. 3 illustrates the concept of vortex shedding across an object 28, which may represent the cross-section of an arm of a mast-and-arm supporting structure in accordance with present embodiments. Vortices 30 form due to rotating shear layers in wind 32, resulting in rotational behavior as the wind 32 passes across the object 28. The vortices 30 created depend on the velocity of the wind flow, as well as the shape and size of the object 28. The vortices 30 will eventually peel-off from the object 28 at a specific frequency. For a cylinder, the frequency at which vortex shedding occurs can be derived by:

$$S_t = \frac{fD}{V} \quad \text{(Eq. 1)}$$

where $S_t$ is the Strouhal number, f is the vortex shedding frequency, D is the diameter of the cylinder, and V is the flow velocity. The Strouhal number $S_t$ is a constant that depends on the shape of the object 28 as well as the Reynolds number of the fluid (e.g., air in this context). The frequency f at which vortex shedding occurs is much higher than that for galloping. As vortices 30 are created, alternating areas (e.g., on top and bottom of the illustrated object 28) of reduced pressure result. Vortex Induced Vibration (VIV) occurs as the elastic object 28 moves towards these alternating areas of lower pressure. Since the low pressure areas occur on alternating sides, the object 28 oscillates between these two regions, resulting in structural vibration. Modeling VIV is particularly complex in that VIV is not a small dynamic perturbation super-imposed onto a steady-state motion. Rather, the vibration is an inherently nonlinear, self-governed, multi-degree-of-freedom phenomenon.

With reference to embodiments directed to mast-and-arm support structures utilized near roadways (e.g., sign or traffic signal supporting structures), traffic induced gust may generate loads on the front and underside of the mast-and-arm supporting structure. For example, loads on the front and underside of the traffic signal supporting structure 10 of FIGS. 1 and 2 and its associated attachments (e.g., traffic signals 24) may be produced by automobiles (e.g., trucks) passing by the traffic signal supporting structure 10. Traffic induced gusts produce turbulences, and therefore vibrations, of the cantilevered arm 22 in both vertical and horizontal directions. In damped structures, traffic induced gust causes basically free vibrations that disappear once the traffic has passed. In areas with low traffic volumes, vibrations from traffic induced gust are not typically considered an issue that leads to fatigue failure. As such, in general, traffic induced gust is less critical than wind induced vibration by galloping or vortex shedding.

Natural wind gust also occurs due to turbulence, but is essentially a so-called "along-wind" phenomena. However, in this case, the turbulence is initiated by changing wind speed and wind direction. The excitation force (i.e., magnitude and direction) of the arm 22 changes randomly with time, as opposed to with vortex-shedding or galloping. Therefore, the effect of natural wind gust is similar to traffic induced gust, and is generally less critical than the across-wind effects of galloping and vortex shedding vibrations.

One method for mitigating the vibrational effects of the four excitation mechanisms (e.g., galloping, vortex shedding, traffic induced gust, and natural wind gust) is to improve the fatigue life of the materials used in the arm 22 of the traffic signal support structure 10 of FIGS. 1 and 2. The fatigue life of a material may be expressed by the equation:

$$\varepsilon_{ae} = \frac{\sigma'_f}{E}(2N_f)^b + \varepsilon'_f(2N_f)^c \quad \text{(Eq. 2)}$$

where $\epsilon_{ae}$ is the equivalent half amplitude of the strain range, $N_f$ is the number of constant amplitude cycles that lead to the first observable fatigue crack, and $\sigma'_f$, $\epsilon'_f$, b, and c are fatigue model constants that are determined from coupon testing. The first part of Equation 2 represents the high cycle fatigue component, where the strains are essentially elastic, while the second part of Equation 2 represents the low cycle fatigue component, where the strains are large and typically exceed yield. The equation is universal and is used in aerospace, mechanical, and civil engineering applications. If service-life strains are kept within the elastic range, the second part (low cycle fatigue) may be dropped. This has been done for many civil structure applications, with the equation recast to:

$$N_f = AS_r^{-3.0} \quad \text{(Eq. 3)}$$

where $S_r$ is the double amplitude (i.e., peak to trough) stress range amplitude, and A is the AASHTO (American Association of State Highway and Transportation Officials) fatigue category coefficient. The variable A may be calibrated for welded steel structures, where six categories exist (i.e., A through E and E' where A is essentially bare metal, and the higher letter categories represent increasingly inferior fatigue life due to the type of weld).

Equation 3 also applies to other situations, such as double-headed nuts at the base of light poles where category C may be assumed. By rearranging Equation 3, it is possible to assess the fatigue life capacity of a connection in years as follows:

$$T_f = \frac{A}{31.6 \times 10^6 S_r^3} T_n \quad \text{(Eq. 4)}$$

where $T_n$ is the natural period of vibration in seconds. The dynamic response, along with the actual stress reversals, should be predominantly governed by the first mode of vibration.

The fatigue life demand needs to be formed by undertaking measurements of the vibration structure in its natural wind environment. If sampled over a variety of wind speeds, the stress range may be measured and then determined as an empirical function of wind speed and direction. The stress ranges, even over a relatively short period of time, may be quite variable. Therefore, the stresses should be converted into constant amplitude to enable this to be applied into Equation 3.

This leads to the subject of cycle counting methods. The "rainflow counting method" may be used to convert variable amplitude time histories into equivalent constant amplitude solutions. A simple program may be used to convert the variable amplitude into blocks of constant amplitude stresses. Then, the variable amplitude time history may be converted into an equivalent constant amplitude that will impose the same degree of fatigue damage, as follows:

$$S_{re} = \left(\frac{1}{n}\sum_{1}^{m} S_r^3\right)^{\frac{1}{3}} \quad \text{Eq. 5}$$

where n is the total number of cycles for m blocks with stress amplitude $S_{re}$. This may be conceived of as a "Root Mean Cube" (RMC) stress range. A probabilistic approach may be employed, where intrinsic functions within common software may be used. For example, if all points in a time history are taken, rather than just counting peaks, it may be shown that:

$$S_{re}=2\sqrt{2}\sigma \quad \text{Eq. 6}$$

where σ is the standard or Root Mean Square (RMS) of the response. This becomes a simple and convenient alternative to the rainflow counting method of data analysis.

In general, there are two ways to increase fatigue life. One may first attempt to reduce the stress range $S_r$. For example, by reducing the stress range $S_r$ by 50%, the fatigue life is increased by a factor of 8. However, another method of increasing fatigue life is to increase fatigue resistance (capacity). According to Equation 4 above, this may be done by changing the details such that the fatigue category is changed. For example, in the context of the traffic signal support structure 10 of FIGS. 1 and 2, increasing the thickness of an end plate of the traffic signal support structure 10 or using ultrasonic impact treatment (UIT) for welds of the arm-to-mast connection 26 and/or a mast-to-foundation connection (i.e., the base plate 18) may increase the fatigue life to a different category.

However, it is now recognized that a different approach may be to remove tension stresses entirely. The embodiments presented herein are directed toward removing the tension stresses in the arm-to-mast connection (e.g., the arm-to-mast connection 26) and/or a mast-to-foundation connection (e.g., the base plate 18) of a mast-and-arm supporting structure, such as the traffic signal supporting structure 10 of FIGS. 1 and 2. Using capacity design techniques, mitigation measures may be devised that increase fatigue life substantially, regardless of the wind conditions and loading environment. It should be noted that fatigue failures typically only occur if a connection experiences cyclic loads under tension. It now recognized that by removing the tensile bending stresses using present embodiments, the potential for fatigue failures is greatly reduced. Indeed, for example, by pre-stressing the arm 22 of the traffic signal supporting structure 10 with an appropriate degree of concentric pre-stress, the potential for tensile bending stresses is substantially reduced or even eliminated.

Figure 4:
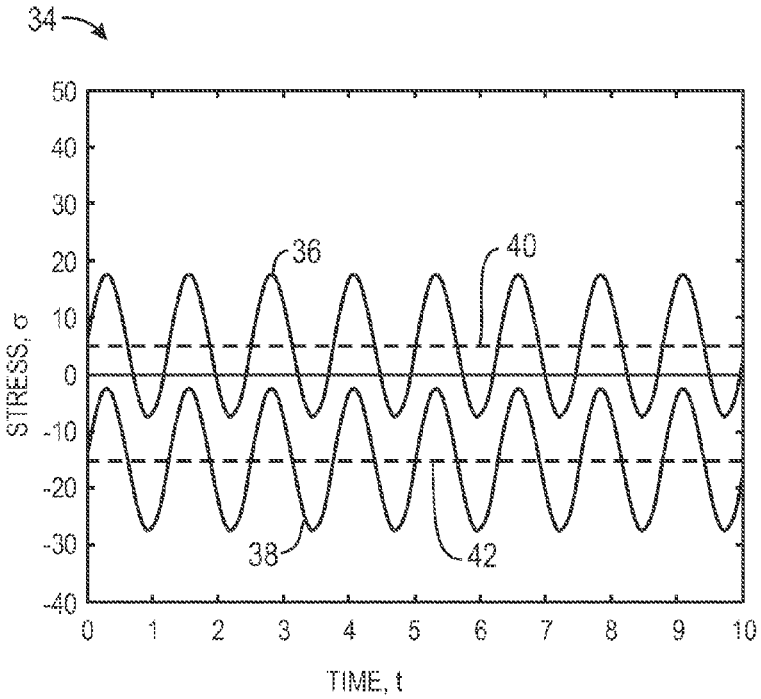
FIG. 4 is a graph of a first time series illustrating stress distribution over time due to bending ranges from compression to tension for a conventional mast-and-arm supporting structure, and a second time series illustrating stress distribution over time for a post-tensioned mast-and-arm supporting structure in accordance with present embodiments.

FIG. 4 is a graph 34 of a first time series 36 illustrating the conventional stress distribution over time due to bending ranges from compression to tension, and a second time series 38 illustrating stress distribution over time for a post-tensioned traffic signal supporting structure 10. In addition, a first dashed line 40 illustrates the average stress of a conventional traffic signal supporting structure 10, whereas the second dashed line 42 illustrates the average stress after post-tensioning of the traffic signal supporting structure 10. As illustrated, the second series 38 illustrating stress distribution and the second dashed line 42 illustrating average stress for a post-tensioned traffic signal supporting structure 10 are substantially lower than the first series 36 illustrating stress distribution and the first dashed line 40 illustrating average stress for a conventional traffic signal supporting structure 10.

Figure 5:
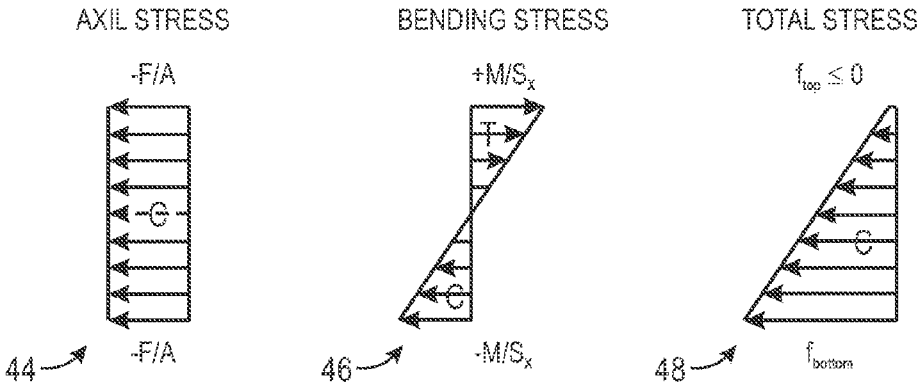
FIG. 5 illustrates an example of the axial stress, bending stress, and total stress of a pre-stressed mast-and-arm supporting structure in accordance with present embodiments.

By superimposing axial compression stresses of the material, the tensile stresses can be greatly reduced. For example, FIG. 5 illustrates an example of the axial stress 44, bending stress 46, and total stress 48 of a pre-stressed traffic signal supporting structure 10. As illustrated in FIG. 5, the axial stress 44 is generally equal to F/A, where F is the axial force and A is the cross-sectional area (e.g., of the arm 22 of the traffic signal supporting structure 10). As also illustrated in FIG. 5, the bending stress 46 is generally equal to the $M/S_x$, where M is the moment about an axis (e.g., an axis transverse of the arm 22 of the traffic signal supporting structure 10) and $S_x$ is the section modulus about the axis. Therefore, the total stress 48 (i.e., the axial stress 44 plus the bending stress 46) may be greatly reduced for a traffic signal supporting structure 10 having a pre-stressed arm 22. Indeed, as illustrated in FIG. 5, the total stress 48 at the top of the arm 22 (i.e., $f_{top}$) may be approximately zero or slightly less than zero under certain conditions, with the total stress 48 at the bottom of the arm 22 (i.e., $f_{bottom}$) being generally negative.

The embodiments presented herein use a post-tensioning device in conjunction with an arm-to-mast connection (e.g., connection 26) of a mast-and-arm supporting structure (e.g., traffic signal supporting structure 10). The arm-to-mast connection may consist of either a standard arm-to-mast connection or a rocking connection arm-to-mast connection. The post-tensioning device may consist of a stressed cable, a post-tensioned bar (e.g., a DYWIDAG bar), a threaded rod, or another suitable post-tensioning device.

Figure 6:
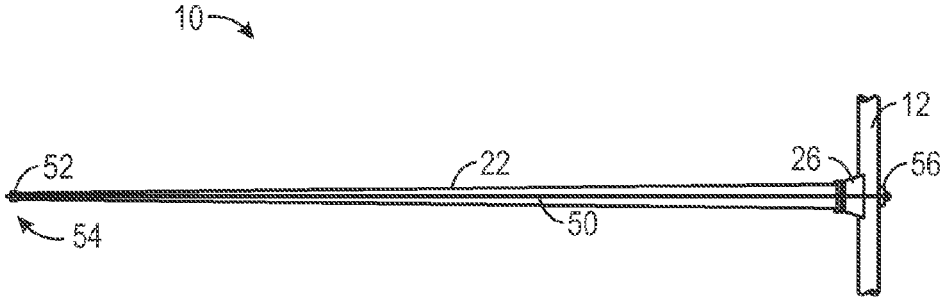
FIG. 6 is a transparent side view of a mast-and-arm supporting structure having a post-tensioning device connecting a first bearing plate disposed at a distal end of an arm to a second bearing plate attached to a mast in accordance with present embodiments.

FIG. 6 is a transparent side view of the traffic signal supporting structure 10 of FIGS. 1 and 2 having a post-tensioning device 50 disposed internal to the arm 22, which provides concealment of the post-tensioning device 50 and other efficiencies. The device 50 is coupled with a first bearing plate 52 disposed at a distal end 54 of the arm 22 and coupled with a second bearing plate 56 attached to the mast 12 at a position aligned with the arm 22. In the embodiment illustrated in FIG. 6, the post-tensioning device 50 is disposed within an interior volume of the arm 22, such that the post-tensioning device 50 extends from the first bearing plate 52 through the arm 22, arm-to-mast connection 26, and the mast 12 to the second bearing plate 56. Further, in the illustrated embodiment, the post-tensioning device is essentially at a right angle relative to the mast 12. It should be noted that, although illustrated as being disposed near the distal end 54 of the arm 22, in other embodiments, the first bearing plate 52 may be disposed at any location along the length of the arm 22. As described above, the post-tensioning device 50 of the embodiment illustrated in FIG. 6 is pre-stressed, such that the tension stresses in the traffic signal supporting structure 10 are reduced.

Figure 7:
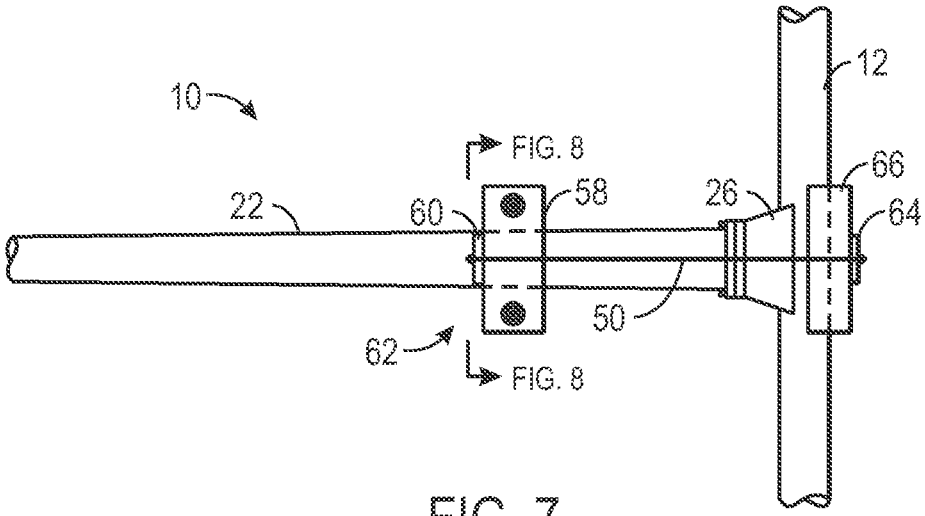
FIG. 7 is a side view of a mast-and-arm supporting structure having a clamp attached externally around an arm and a post-tensioning device extending from the clamp to a bearing plate attached to a mast in accordance with present embodiments.

While there are benefits to embodiments where the post-tensioning device 50 is disposed internal to the arm 22 of the traffic signal supporting structure 10 (as illustrated in FIG. 6), in other embodiments, a post-tensioning device may be disposed external to an arm of a mast-and-arm supporting structure. For example, FIG. 7 is a side view of the traffic signal supporting structure 10 of FIGS. 1 and 2 having a clamp 58 attached radially around the arm 22. As illustrated, the clamp 58 includes a bearing plate 60 on a side 62 of the clamp 58 that is disposed away from the mast 12. The post-tensioning device 50 extends from the bearing plate 60 of the clamp 58 to a bearing plate 64 that is attached to the mast 12. Although not illustrated in the side view of FIG. 7, the clamp 58 includes two bearing plates 60, each disposed on an opposite side of the arm 22, and each having a respective post-tensioning device 50 that extends from the bearing plate 60 to a respective bearing plate 64 that is attached to the mast 12. Similarly, although not illustrated in the side view of FIG. 7, two bearing plates 64 may be disposed on opposite sides of the mast 12. More specifically, in certain embodiments, the bearings plates 64 may be disposed on a separate bearing plate support block 66 that is attached to the mast 12 such that the bearings plates 64 align with their respective post-tensioning devices 50 on opposite sides of the mast 12. Again, as described above, the post-tensioning device 50 of the embodiment illustrated in FIG. 7 is pre-stressed, such that the tension stresses in the traffic signal supporting structure 10 are reduced.

Figure 8:
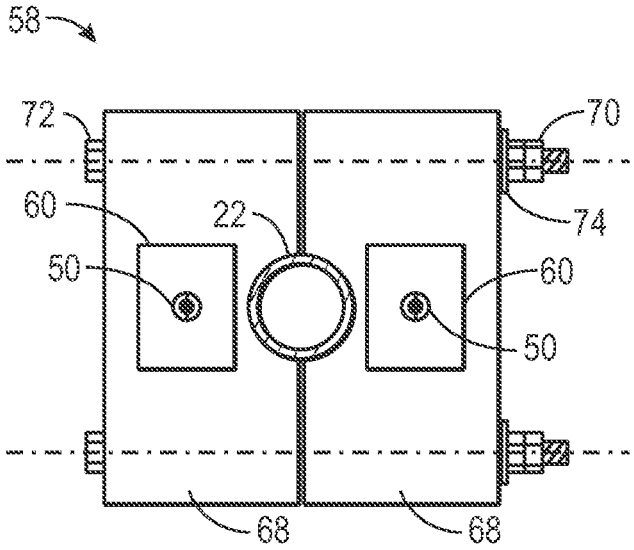
FIG. 8 is an axial side view of the clamp of FIG. 7 and a cross-sectional view of the arm in accordance with present embodiments.

FIG. 8 is an axial side view of the clamp 58 of FIG. 7. As illustrated, in certain embodiments, the clamp 58 may include two halves 68 that are coupled to each other around the arm 22 of the traffic signal supporting structure 10 by sets of nuts 70, bolts 72, and washers 74, wherein the bolts 72 are configured to fit through holes in the two halves 68 of the clamp 58, and the nuts 70 and washers 74 secure the two halves 68 of the clamp 58 together around the arm 22. As also illustrated in FIG. 8, each bearing plate 60 may be attached to a respective half 68 of the clamp 58, such that a corresponding post-tensioning device 50 may be attached to each of the bearing plates 60 and extend to the mast 12 (and the bearing plate 64) of the traffic signal supporting structure 10.

Figure 9:
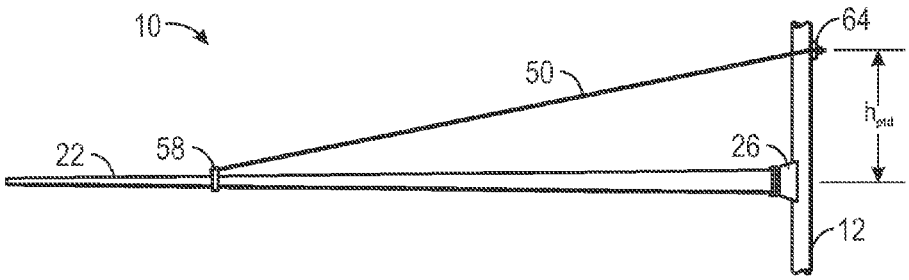
FIG. 9 is a side view of a mast-and-arm supporting structure having a clamp attached externally around an arm and post-tensioning devices extending from a coupling with the clamp to a bearing plate attached to the mast at a vertical height above the arm-to-mast connection in accordance with present embodiments.

The embodiments illustrated in FIGS. 6 and 7 include post-tensioning devices 50 that extend generally horizontally and parallel to the arm 22 of the traffic signal supporting structure 10. However, in other embodiments, the post-tensioning devices 50 may instead connect at different vertical locations on the mast 12, such that the stability of the traffic signal supporting structure 10 is adjusted. In general, when the post-tensioning devices 50 are attached at different vertical locations on the mast 12, they will be attached above the clamp 58. For example, FIG. 9 is a side view of the traffic signal supporting structure 10 of FIGS. 1 and 2 having the clamp 58 attached externally around the arm 22 and post-tensioning devices 50 extending to a bearing plate 64 attached to the mast 12 at a vertical height $h_{ptd}$ substantially above the arm 22 and the arm-to-mast connection 26. For example, in certain embodiments, the bearing plate 64 may be attached to the mast 12 at a height $h_{ptd}$ above the arm 22 and the arm-to-mast connection 26 in the range of approximately 3-5 feet. Again, although not illustrated in the side view of FIG. 9, the clamp 58 includes two bearing plates 60, each disposed on an opposite side of the arm 22, and each having a respective post-tensioning device 50 that extends from the corresponding bearing plate 60 to a respective bearing plate 64 that is disposed on opposite sides of the mast 12. Also, as described above, the post-tensioning devices 50 of the embodiment illustrated in FIG. 9 are pre-stressed, such that the tension stresses in the traffic signal supporting structure 10 are reduced.

Figure 10:
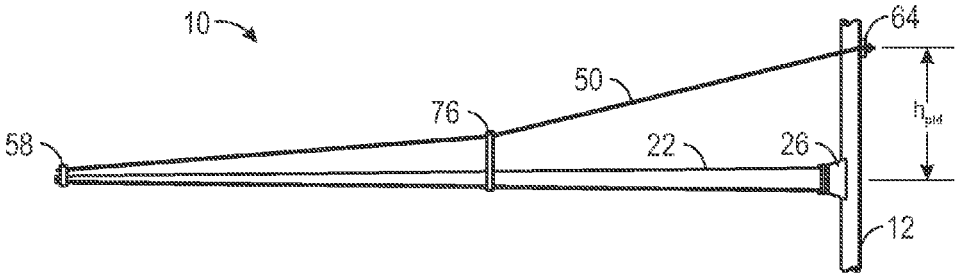
FIG. 10 is a side view of a mast-and-arm supporting structure having a clamp attached externally around an arm, a first post-tensioning device extending from the clamp to a tie bar at some horizontal location along the arm, and a second post-tensioning device extending from the tie-bar to a bearing plate attached to the mast at a vertical height above the arm-to-mast connection in accordance with present embodiments.

An extension of the embodiment illustrated in FIG. 9 is to include more than one post-tensioning device 50 in a harped configuration. For example, FIG. 10 is a side view of the traffic signal supporting structure 10 of FIG. 9 having the clamp 58 attached externally around the arm 22, a first post-tensioning device 50 extending from the clamp 58 to a tie bar 76 at some horizontal location along the arm 22, and a second post-tensioning device 50 extending from the tie-bar 76 to the bearing plate 64 attached to the mast 12. As such, the post-tensioning devices 50 of FIG. 10 provide more stability to the traffic signal supporting structure 10. Also, as described above, the post-tensioning devices 50 of the embodiment illustrated in FIG. 10 are pre-stressed, such that the tension stresses in the traffic signal supporting structure 10 are reduced. It should be noted that various combinations of the disclosed embodiments may be used according to present techniques. For example, the embodiments illustrated in FIGS. 9 and 10 may also incorporate a post-tensioning device 50 disposed within the arm 22 along with corresponding features.

Figure 11:
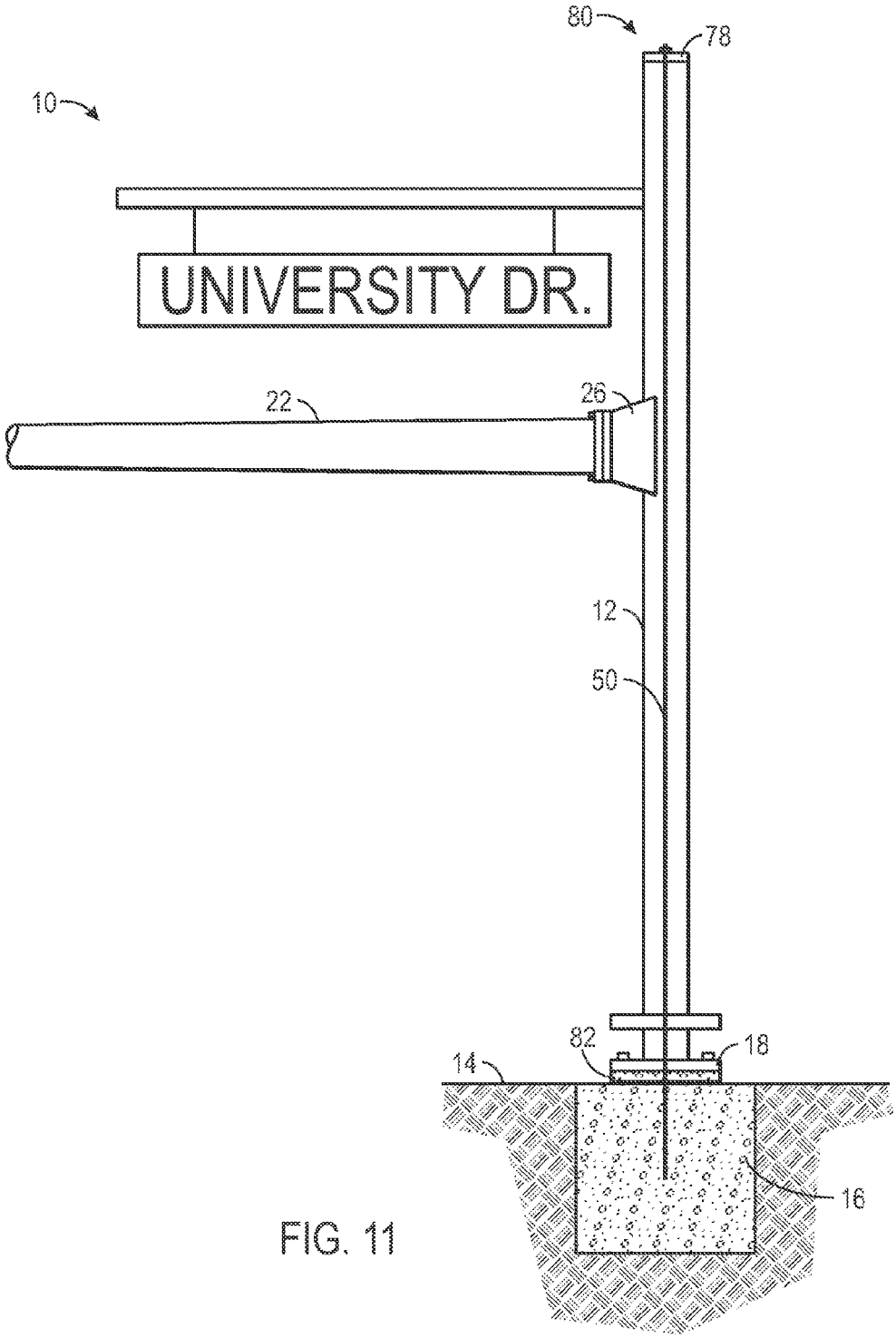
FIG. 11 is a transparent side view of a mast-and-arm supporting structure with a post-tensioning device connecting a bearing plate disposed at a distal end of the mast to a base plate, which attaches the mast to the foundation in accordance with present embodiments.

Similar to the embodiments described above, which include post-tensioning devices 50 generally along the horizontal arm 22 of the traffic signal supporting structure 10, in other embodiments, pre-stressing of the vertical mast 12 may be applied for protecting the base of the mast 12 from certain stresses. For example, FIG. 11 is a transparent side view of the traffic signal supporting structure 10 of FIGS. 1 and 2 having a post-tensioning device 50 connecting a bearing plate 78 disposed at an upper distal end 80 of the mast 12 to the base plate 18, which attaches the mast 12 to the foundation 16. In the embodiment illustrated in FIG. 11, the post-tensioning device 50 is disposed within an interior volume of the mast 12, such that the post-tensioning device 50 extends from the bearing plate 78 through the mast 12 to the base plate 18. In certain embodiments, the post-tensioning device 50 may include a high-strength, high-alloy pre-stressing threadbar (e.g., of a coil rod type), using grout 82 between the base plate 18 and the foundation 16. The embodiment illustrated in FIG. 11 significantly reduces the tensile forces near the base plate 18 of the mast 12 and, therefore, reduces the potential for fatigue at this location.

Figure 12:
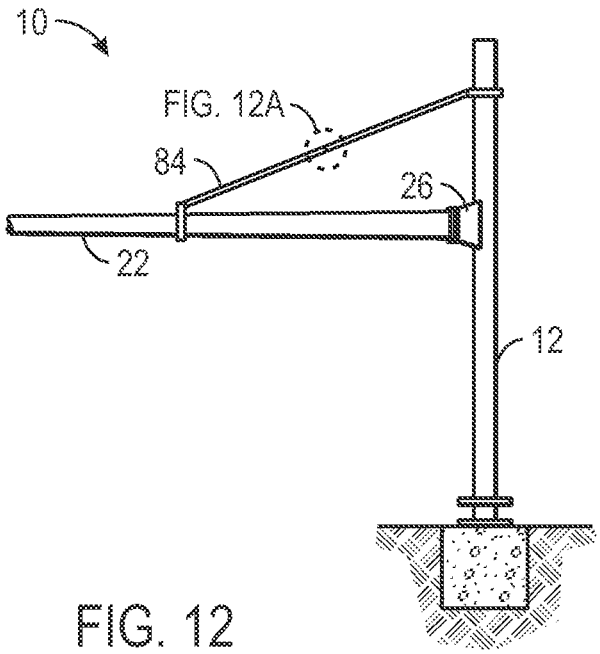
FIG. 12 is a side view of a mast-and-arm supporting structure including a fuse-bar that connects the arm to the mast in accordance with present embodiments.
Figure 12A:
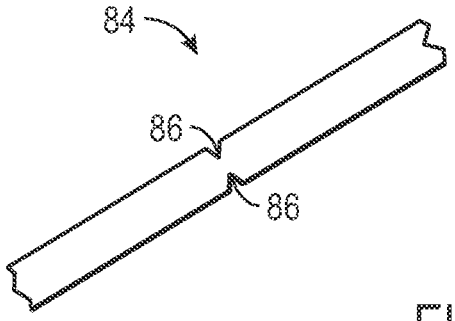
FIG. 12A is a side view of the fuse-bar of FIG. 12, illustrating predetermined reduced-section points on opposite sides of the fuse-bar, which may be representative of multiple such points in accordance with present embodiments.

In certain embodiments, fatigue and fracture in the arm-to-mast connection of a mast-and-arm supporting structure may be further mitigated using a fuse-bar that connects the arm to the mast. For example, FIG. 12 is a side view of the traffic signal supporting structure 10 of FIGS. 1 and 2 having a fuse-bar 84 that connects the arm 22 to the mast 12. In addition, FIG. 12A is a side view of the fuse-bar 84 of FIG. 12, illustrating the fact that the fuse-bar 84 has a reduced cross section area at one or more points 86 along the fuse-bar 84. The fuse-bar 84 is under tension, thus reducing or even eliminating the tension in the arm-to-mast connection 26. In addition, the fuse-bar 84 undergoes cyclic loading, and is fatigue and fracture critical. However, since the fuse-bar 84 has the reduced cross section area at one or more points 86, yield stress will occur at these locations, which will limit the amount of force transfer. Indeed, in certain embodiments, paint layering and so forth may be employed to identify whether yield has occurred, such that the fuse-bar 84 functions as an alert feature. In the unlikely event that the fuse-bar 84 fails by fracture, the traffic signal supporting structure 10 will not fail. Rather, the fuse-bar 84 may simply be replaced as resources become available. It should be understood that a similar fuse-bar 84 may also be used in a similar manner to reduce or even eliminate the tension in a mast-to-foundation connection (i.e., the base plate 18).

As described above, the embodiments presented herein greatly reduce the tension in the arm-to-mast connection (e.g., connection 26) and/or a mast-to-foundation connection (i.e., the base plate 18) of a mast-and-arm supporting structure. Thus, present embodiments increase the fatigue life of the arm-to-mast connection and/or a mast-to-foundation connection and reduce the potential for damage to the mast-and-arm supporting structure. In addition, the embodiments presented herein reduce inspection and maintenance costs associated with the mast-and-arm supporting structures inasmuch as the potential for fatigue cracking in the mast-and-arm supporting structures is greatly reduced. Further, present embodiments may prevent complete collapse of a mast arm in the event of failure by holding the components together via cabling or the like. It should be noted that the examples provided in the present disclosure are generally directed to the traffic signal supporting structure 10. However, this is merely one representative embodiment of a mast-and-arm supporting structure.

Experimentation has demonstrated the effectiveness of present embodiments with respect to increasing the fatigue life of features of a mast-and-arm supporting structure. Indeed, an arrangement such at that illustrated in FIG. 6 was monitored using strategically placed in-plane transducers, out-plane transducers, and axial transducers to gage strain at connections (e.g., the mast-to-arm connection). Also, weather conditions (e.g., wind direction, wind speed, and other weather-related variables) were monitored. As illustrated in FIG. 6, the experimental embodiment included a post-tensioning device 50 that applied internal post-tensioned pre-stress over the entire length of the mast-arm 22. The post-tensioning device 50 included a 0.6 inch tendon with a 5 inch eccentricity that was tensioned using a hydraulic tensioning device. However, in other embodiments, different mechanisms (e.g., a threaded rod and tightening device) may have been utilized.

Figure 13:
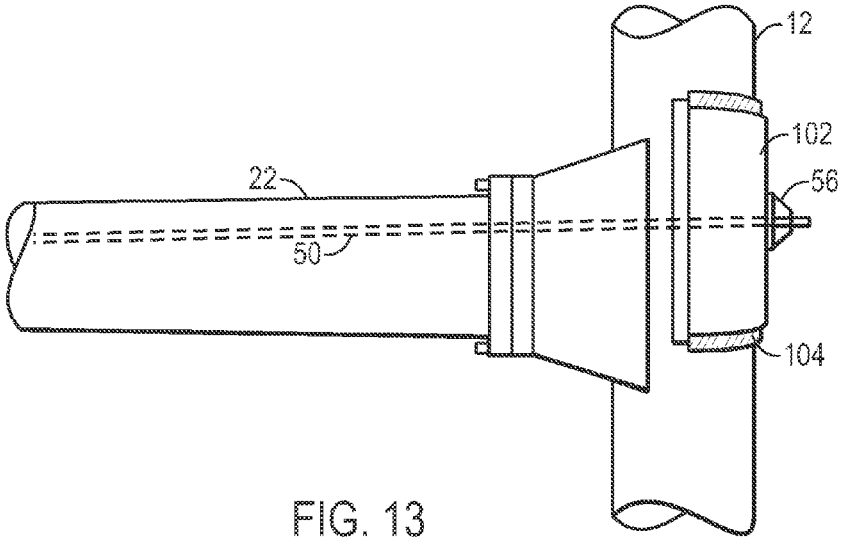
FIG. 13 is a side view of a mast-and-arm supporting structure including a post-tensioning device coupled to a bearing plate and including a curved bracket and rubber pad to distribute load in accordance with present embodiments.

In contrast to the embodiment illustrated in FIG. 6, the end of the post-tensioning device 50 coupled to the second bearing plate 56 at the mast 12 was slightly elevated relative to the end of the post-tensioning device 50 coupled to the first bearing plate 52 at the distal end 54 of the arm 22, which increased desired bending upward. Such a placement is illustrated in FIG. 13, and may adjust for forces associated with gravity. Further, as illustrated in FIG. 13, the second bearing plate 56 was positioned adjacent a curved bracket 102, which was in turn positioned adjacent a rubber pad 104 to better distribute load to the mast 12. As will be discussed below, this addition also provided a damping effect.

Figure 14:
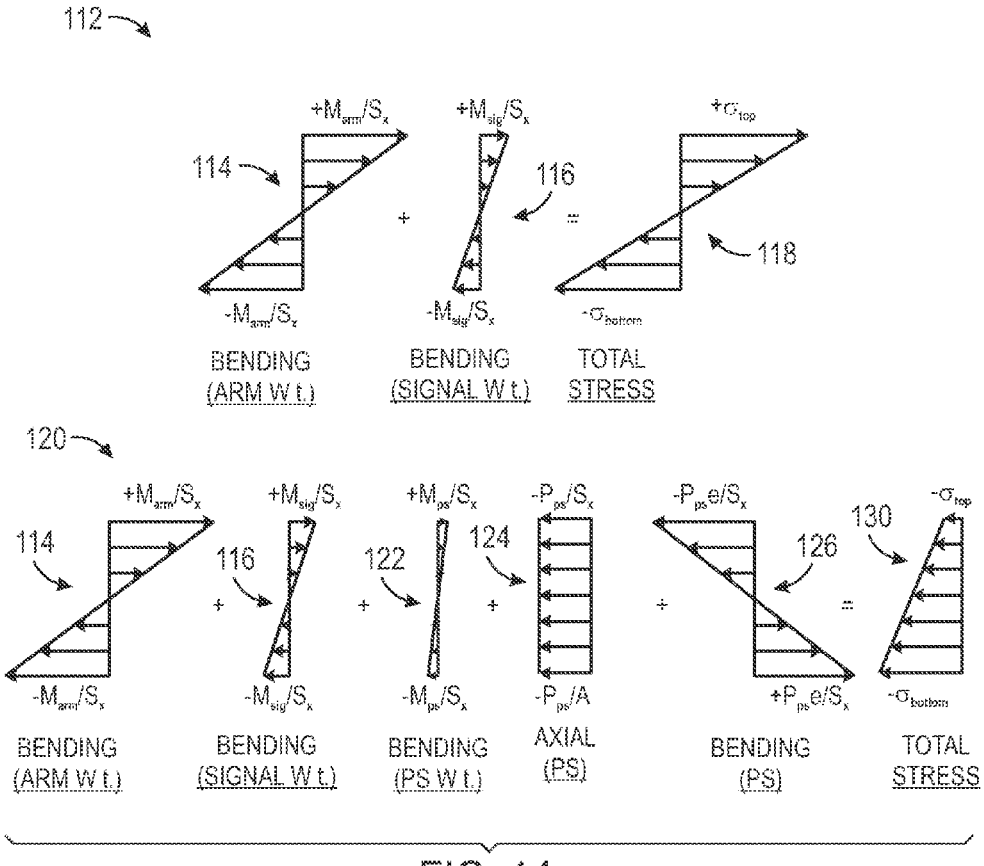
FIG. 14 illustrates an example of various summed stresses on a mast-and-arm supporting structure before and after including a pre-stressed device in accordance with present embodiments.

FIG. 14 illustrates an example of various summed stresses on a mast-and-arm supporting structure before and after including a pre-stressed device in accordance with present embodiments. Specifically, the sum of stresses indicated by reference numeral 112 includes arm weight stress 114, signal weight stress 116, and total stress 118. The arm weight stress 114 is defined as bending moment of an arm ($M_{arm}$) relative to the section modulus about the axis ($S_x$), and the signal weight stress 116 is defined as bending moment of the signals (e.g., signals 24) relative to the section modulus $S_x$. The total stress 118 ($\sigma$) for the top and bottom of the arm is determined by adding the arm weight stress 114 and the signal weight stress 116. This traditional arrangement, as illustrated by the sum of stresses 112, is contrasted in FIG. 14 with the sum of stresses 120 based on present embodiments, which includes the arm weight stress 114, the signal weight stress 116, tendon weight stress 122, axial stress 124, and eccentricity stress 126. The tendon weight stress 122 is the additional weight of the tendon or cable ($M_{ps}$) relative to $S_x$, the axial stress 124 is the tension applied to the arm-to-mast connection by the tendon ($P_{ps}$) relative to $S_x$, and eccentricity (e) in the eccentricity stress 126 is an adjustment for offsetting the connection points of the tendon at the ends relative to one another. These stresses all sum to the total stress 130 for top and bottom of the arm.

Figure 15:
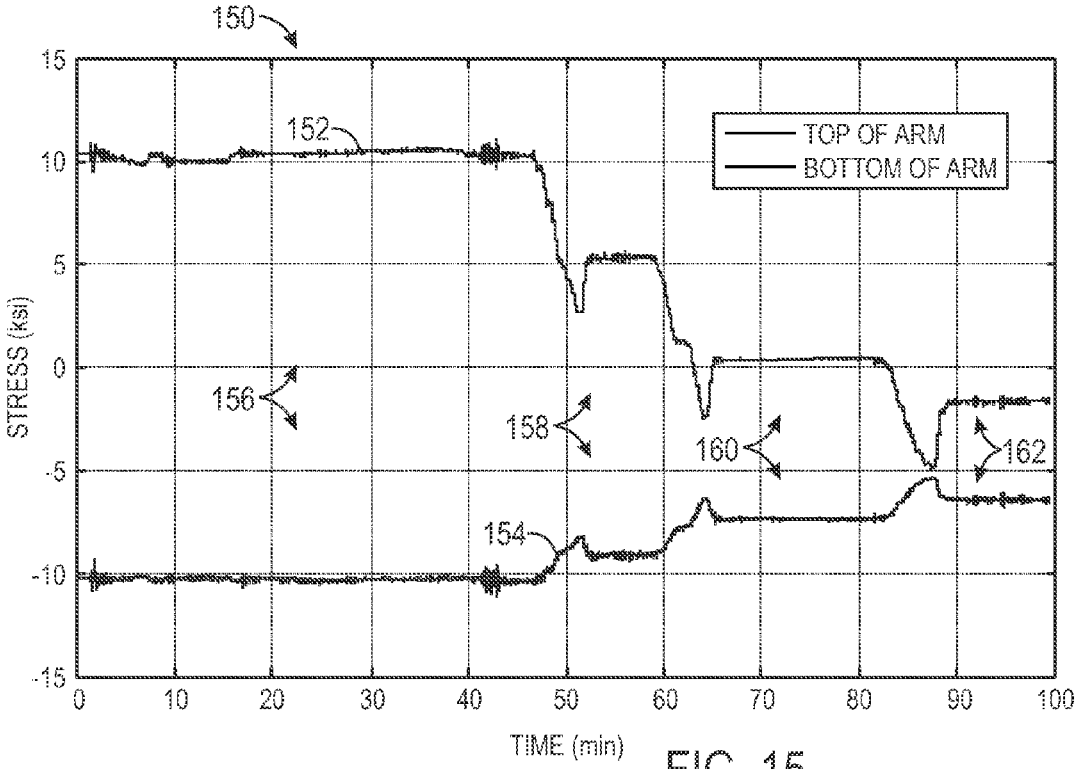
FIG. 15 includes a chart of stress and time data acquired via experimentation with a mast-and-arm supporting structure in accordance with present embodiments.

FIG. 15 is a chart 150 of data acquired via experimentation with the mast-and-arm supporting structure discussed above, wherein the data includes stress (ksi) over time (min) acquired from the various transducers discussed above. Referring to the chart 150, the upper series 152 represents stress on the top of the arm 22 and the lower series 154 represents stress on the bottom of the arm, as observed proximate the mast-to-arm connection by the transducers. As can be observed in FIG. 15, there are generally four distinguishable levels of stress. A first level 156 is relatively high and represents no tension on the tendon, while a second level 158, third level 160, and fourth level 162 each represent steps of increased tension on the tendon. At the fourth level 162, the tension was approximately ten tons. As can be seen, the stress at the top of the arm, as represented by the upper series 152, was substantially reduced at each step of increased tension on the tendon. Likewise, the stress at the bottom of the arm, as represented by the lower series 154, was reduced by a slightly less amount as the tension on the tendon progressed. In summary, the chart 150 shows elimination of tensile bending stresses and a reduction in compressive bending stresses near the mast-to-arm connection.

Figure 16:
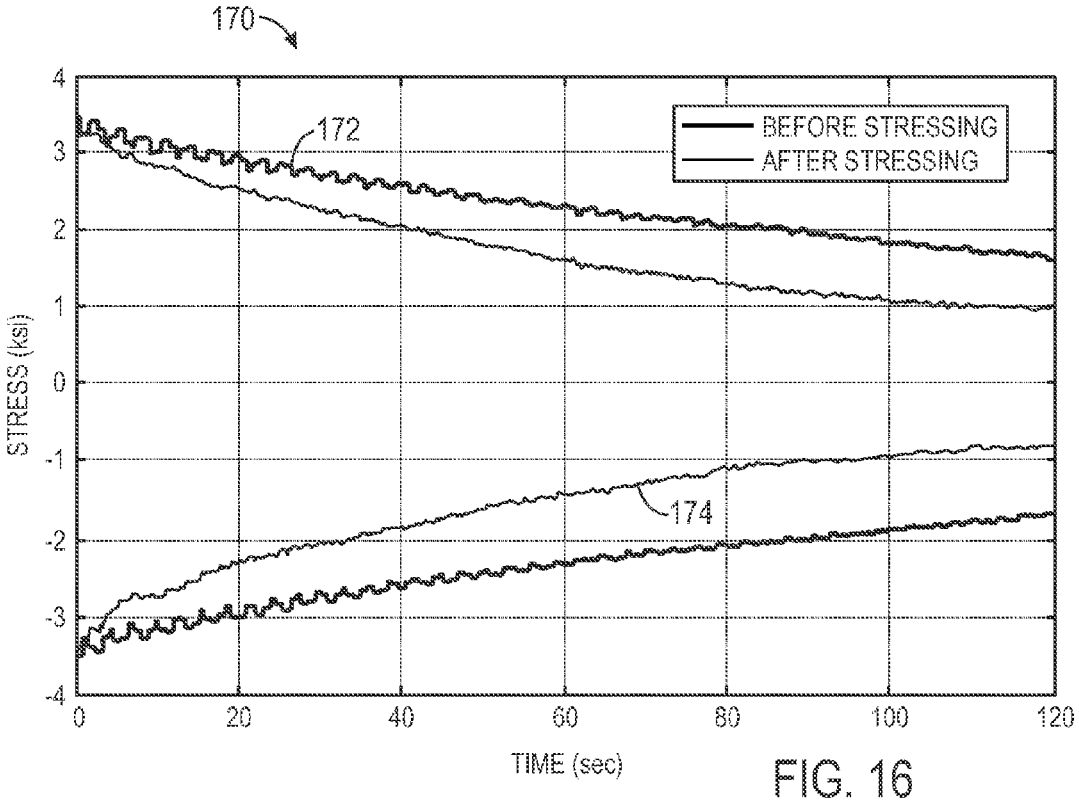
FIG. 16 includes a graph of stress over time for a mast-to-arm connection in-plane bending stress during free vibration illustrating results of implementation of present embodiments.

It should also be noted that damping increases with post-tensioning, as evident from free vibration recordings, as illustrated by graph 170 in FIG. 16, wherein the graph 170 includes plots of stress over time (mast-to-arm connection in-plane bending stress during free vibration). Specifically, the data presented in the graph 180 represent stress levels over time in a mast-to-arm connection of a mast-and-arm supporting structure before applying stress via the tendon (series 172) and stress levels in the structure over time after applying stress via the tendon (series 174). At least some of this damping can be attributed to employing the rubber pad 104, as discussed above. Indeed, damping is essentially a secondary but beneficial effect of present embodiments.

Figure 17:
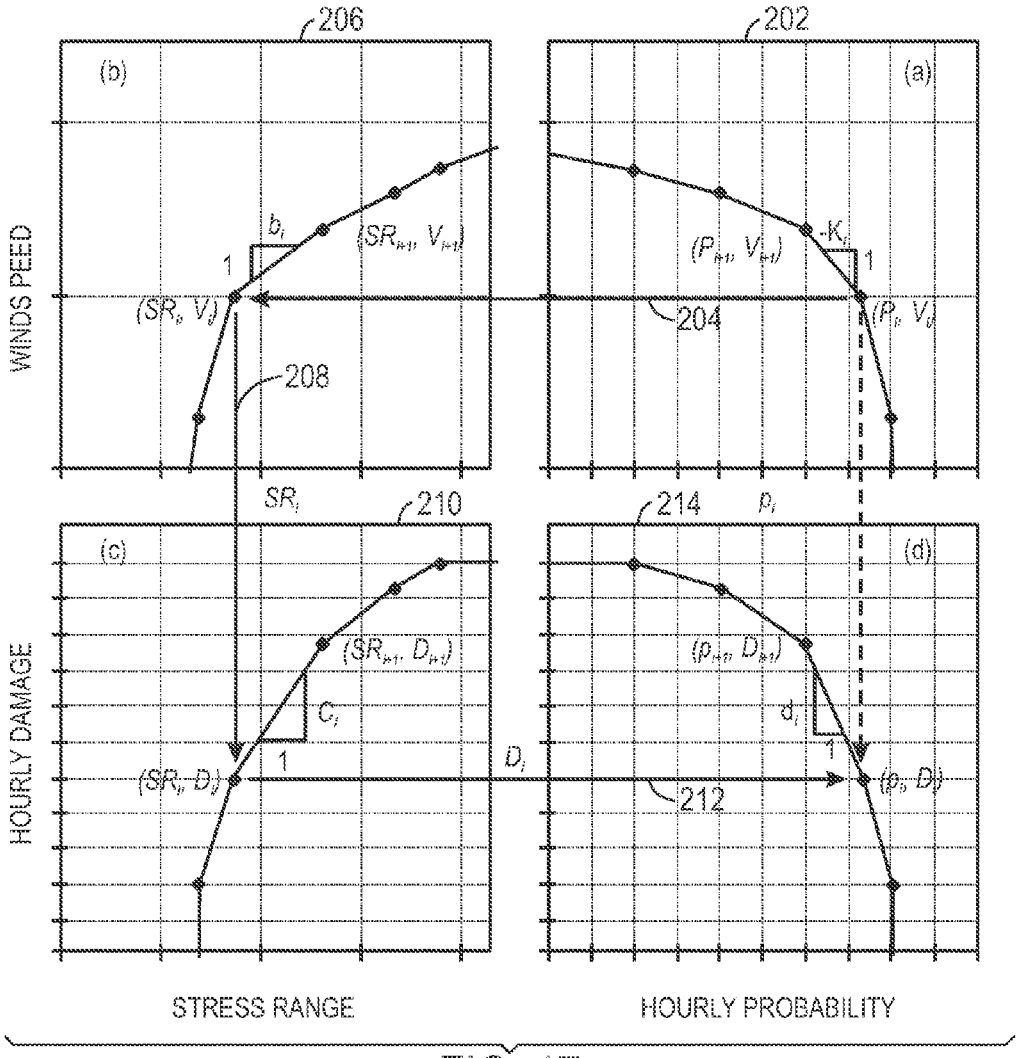
FIG. 17 includes four log-log graphs that visually inter-relate four steps for estimating the fatigue-life of a fatigue-prone structure in accordance with present embodiments.

Additionally, data has been obtained to estimate the fatigue-life of a mast-and-arm supporting structure with and without post-tensioning features in accordance with present embodiments. Specifically, data for an area with relatively benign daily winds and data from an area with fresh daily winds was acquired an analyzed, as presented in the charts discussed below. Prior to discussing the details of these charts, it is useful to describe the four-step approach involved in estimating the fatigue-life of a fatigue-prone structure. The main objective of using this approach is to relate estimated fatigue damage in terms of well-known cyclic stress demand and structural response parameters. FIG. 17 shows the four steps (step (a), step (b), step (c), and step (d)) as visually inter-related through the use of log-log graphs. The four graphs are interrelationships via power equations. These equations are plotted as linear lines in log-log scale between specified coordinates. On the basis of the observation that fatigue damage relations, along with other functions that lead to calculated results are mostly linear in log-log space, the four-step damage estimation approach can be unified into a single compound equation that takes the general form:

$$\frac{D}{D_i} = \left|\frac{SR}{SR_i}\right|^{c_i} = \left|\frac{v}{v_i}\right|^{b_i c_i} = \left|\frac{p}{p_i}\right|^{d_i} \quad \text{(Eq. 7)}$$

in which D=hourly fatigue damage ratio; SR=the stress-range for a critical location under consideration; v=hourly average wind speed that exciting the structure; and p=hourly probability of that wind occurring at a given location. The subscript i, represents the $i^{th}$ data point; and k, b, c, and d are exponents that relate to the slope of the line between the $i^{th}$ and $i^{th}$+1 data points in each of the four graphs.

FIG. 17 presents four graphs that show the inter-relationships given in Equation 7. The four graphs are inter-related because the neighboring two graphs (one beside and one either below or above) use axes that have the same scales. Starting in Graph 202 the local wind hazard is plotted in terms of the wind velocity (v, which is the wind's intensity measure) versus the probability (p) that the wind speed will be that average speed for one-hour. By following a horizontal arrow 204 to the left, it is evident that when the wind strikes a structure, this imposes a dynamic response that leads to vibrations and a thereby induces a cyclic stress range, SR, as shown in Graph 206. Then by following a vertical arrow 208 downward to Graph 210, fatigue damage occurs for that hour of effective constant amplitude cyclic stress-range. Note that the inverse of this hourly damage for that stress-range may also be considered as the number of hours needed to lead to a fatigue crack. Finally, by following an arrow 212 to the right, the fatigue damage is related to the hourly probability of occurrence of the originating wind speed, as shown in Graph 214.

The slopes of curves in log-log space between two points, i and i+1 are also inter-related such that d=−bc/k, in which k=slope of the log-log linear model shown in Graph 202. Similarly, as shown in Graph 206, b=the slope of that log-log linear model; note that for high wind speeds it is well known that wind pressure is proportional to the square of the wind press, thus b=2. For the Graph 210, c=the slope of that log-log linear model, note that this will be approximately c=3, which is consistent with well-known fatigue models for welded steel connections, however, this damage model should be calibrated for mean-stress effects accordingly.

Figure 18:
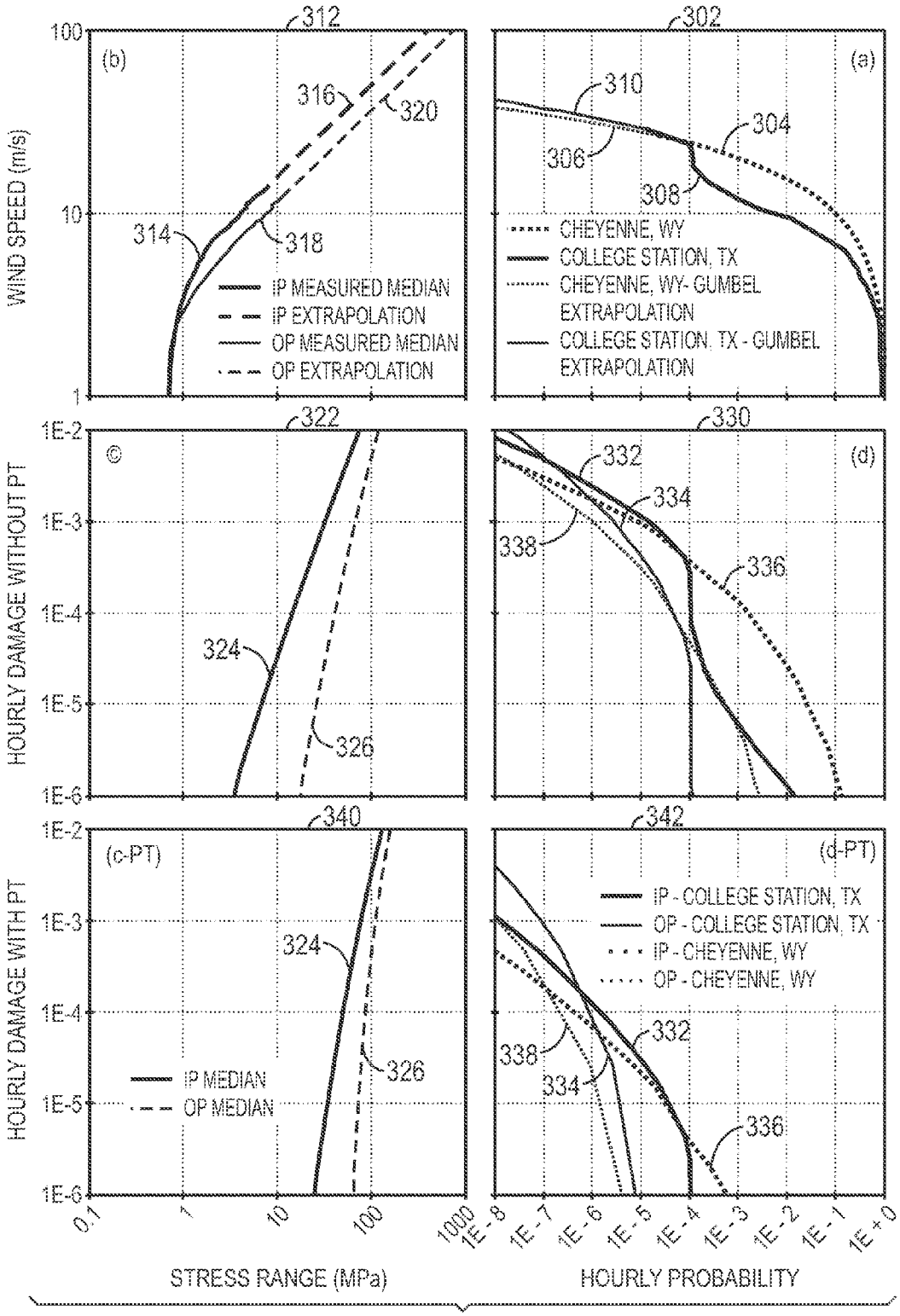
FIG. 18 includes six graphs that show inter-relationships for a mast-and-arm supporting structure excluding and including a post-tensioning device in accordance with present embodiments.
Figure 19:
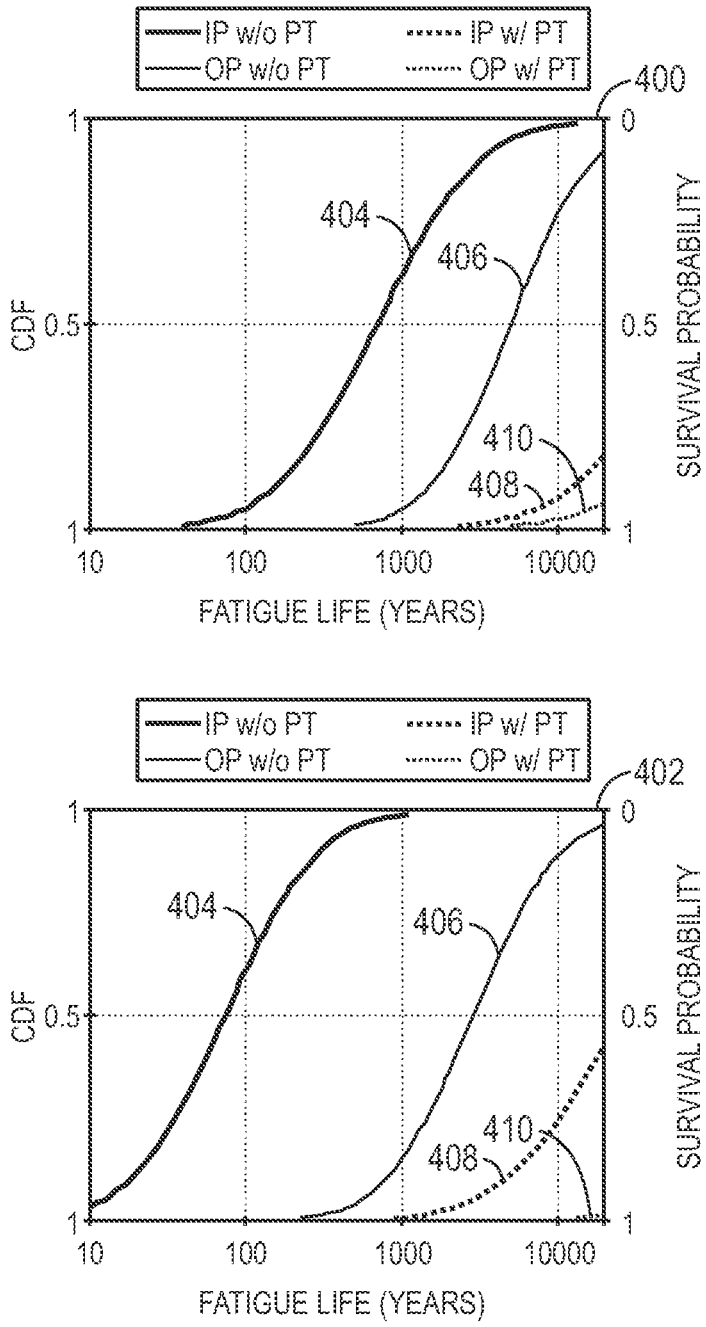
FIG. 19 includes plots of survival probability and fatigue life for different structures with and without post-tensioning in accordance with present embodiments.

In view of the procedures discussed above with respect to FIG. 17, the data set fort in FIGS. 18 and 19 will be readily understood by one of ordinary skill in the art. FIG. 18 includes six graphs that show the inter-relationships given in Equation 7 for a mast-and-arm supporting structure excluding and including a post-tensioning device in accordance with present embodiments. Each of the graphs in FIG. 18 includes data related to College Station, Tex. and data for Cheyenne, Wyo. These two locations are relevant because College Station has relatively benign daily winds and Cheyenne experiences fresh daily winds that lead to constant dynamic response. Specifically, Graph 302 is representative of a wind hazard model and includes plots for wind speed (m/s) versus hourly probability for Cheyenne 304, extrapolated Cheyenne 306, College Station 308, and extrapolated College Station 310. The extrapolations in Graph 302 are based on Gumbel Extrapolation. Graph 312 is representative of a structural response and includes plots of wind speed (m/s) versus stress range (MPa) for in-plane 314, in-plane extrapolated 316, out-plane 318, and out-plane extrapolated 320. Graph 322 is representative of a damage model for structure without post-tensioning and includes plots of hourly damage versus stress range (MPa) for in-plane median 324 and out-plane median 326. Graph 330 is representative of a damage estimation for structure without post-tension including plots of hourly damage versus hourly probability for in-plane College Station 332, out-plane College Station 324, in-plane Cheyenne 336, and out-plane Cheyenne 338. Graph 340 is representative of a damage model for structure with post-tensioning and includes the corresponding plots 324 and 326. Graph 342 is representative of damage estimation for structure with post-tensioning and includes the corresponding plots of 332, 334, 336, and 338.

FIG. 19 includes a Graph 400 of survival curves for a mast-and-arm supporting structure in College Station, Tex., and a Graph 402 that includes survival curves for a mast-and-arm supporting structure in Cheyenne, Wyo. Each of the Graphs 400, 402 includes a plot of in-plane without post-tensioning 404, a plot of out-plane without post-tensioning 406, a plot of in-plane with post-tensioning 408, and a plot of out-plane with post-tensioning 410. In view of this, there is a high confidence level that fatigue life of the mast-and-arm structure will exceed 100 years in College Station, which implies less need to mitigate tension-critical proneness of this class of structure. However, with respect to Cheyenne, the data suggests that the structure (absent employment of present embodiments) may not survive more than twenty years without the possibility of fatigue failure. To mitigate this, post-tensioning the arm in accordance with present embodiments essentially removes the tension-critical weld detail from being critical and technically extends the fatigue life well beyond 1000 years. Clearly, a mast-and-arm supporting structure in such a location would benefit from present embodiments.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A mast-and-arm supporting structure, comprising:

a mast extending substantially vertically from a foundation;

an arm extending substantially horizontally from an arm-to-mast connection that couples the arm to the mast; and a post-tensioning device coupled proximate a first end of the post-tensioning device to the arm via a first bearing plate and coupled proximate a second opposite end of the post-tensioning device to the mast via a second bearing plate, wherein the post-tensioning device is pre-stressed, wherein the post-tensioning device is disposed internal to the arm, the arm-to-mast connection, and the mast, and wherein the second bearing plate is positioned vertically above the first bearing plate such that the post-tensioning device angles upward from the first bearing plate toward the second bearing plate within the arm.

2. The mast-and-arm supporting structure of claim 1, comprising a bearing plate support block coupled to the mast, wherein the second bearing plate is coupled to the bearing plate support block.

3. The mast-and-arm supporting structure of claim 2, comprising a rubber pad positioned between the bearing plate support block and the mast and configured to distribute load onto the mast from the post-tensioning device.

4. The mast-and-arm supporting structure of claim 1, comprising a mast post-tensioning device coupled to a distal end of the mast and extending to a base plate attached to the foundation, wherein the mast post-tensioning device is pre-stressed, and wherein the mast post-tensioning device is disposed internal to the mast.

5. The mast-and-arm supporting structure of claim 1, wherein the post-tensioning device comprises a stressed cable.

6. The mast-and-arm supporting structure of claim 1, wherein the post-tensioning device comprises a post-tensioned bar.

7. The mast-and-arm supporting structure of claim 1, wherein the post-tensioning device comprises a threaded rod.

8. The mast-and-arm supporting structure of claim 1, wherein the mast-and-arm supporting structure comprises a traffic light supporting structure.

9. The mast-and-arm supporting structure of claim 1, comprising a fuse bar coupled to the mast and the arm to facilitate identification of excessive stress.

10. The mast-and-arm supporting structure of claim 1, wherein the arm and mast comprise metal and the foundation comprises concrete.

11. A mast-and-arm supporting structure, comprising:

a metal mast extending substantially vertically from a coupling with a concrete foundation;

a metal arm cantilevered from the mast via an arm-to-mast connection such that the arm extends substantially horizontally from the mast;

a post-tensioning device extending through an internal portion of the arm, wherein the post-tensioning device is pre-stressed;

a first portion of the post-tensioning device coupled to the arm via a first bearing plate; and a second portion of the post-tensioning device coupled to the mast via a second bearing plate wherein the second bearing plate is positioned vertically above the first bearing plate such that the post-tensioning device angles upward from the first bearing plate toward the second bearing plate.

12. The mast-and-arm supporting structure of claim 11, wherein the post-tensioning device spans an entire length of the arm.

13. The mast-and-arm supporting structure of claim 11, comprising a bearing plate support block coupled to the metal mast, wherein the second bearing plate is coupled to the bearing plate support block.

14. The mast-and-arm supporting structure of claim 13, comprising a rubber pad positioned between the bearing plate support block and the metal mast and configured to distribute load onto the metal mast from the post-tensioning device.

15. The mast-and-arm supporting structure of claim 11, wherein the post-tensioning device comprises a stressed cable.

16. The mast-and-arm supporting structure of claim 11, wherein the post-tensioning device comprises a post-tensioned bar.

17. The mast-and-arm supporting structure of claim 11, wherein the post-tensioning device comprises a threaded rod.

18. A mast-and-arm supporting structure, comprising:

a mast extending substantially vertically from a foundation;

an arm extending substantially horizontally from an arm-to-mast connection that couples the arm to the mast; and a post-tensioning device coupled proximate a first end of the post-tensioning device to the arm via a first bearing plate and coupled proximate a second opposite end of the post-tensioning device to the mast via a second bearing plate, wherein the post-tensioning device is pre-stressed, wherein the post-tensioning device is disposed internal to the arm, the arm-to-mast connection, and the mast, and wherein the second bearing plate is positioned vertically above the first bearing plate such that the post-tensioning device angles upward from the first bearing plate toward the second bearing plate within the arm.

* * * * *